United States Patent [19]

Troxler

[11] Patent Number: 4,717,127

[45] Date of Patent: Jan. 5, 1988

[54] PIVOT ASSEMBLY FOR CONNECTING A COVER MEMBER TO A HOUSING OF A SLIDING CLOSURE UNIT

[75] Inventor: Beat Troxler, Hildisrieden, Switzerland

[73] Assignee: Stopinc Aktiengesellschaft, Baar, Switzerland

[21] Appl. No.: 916,739

[22] Filed: Oct. 8, 1986

[30] Foreign Application Priority Data

Nov. 2, 1985 [DE] Fed. Rep. of Germany ... 8530966[U]

[51] Int. Cl.[4] ..... B22D 41/08

[52] U.S. Cl. ..... 266/287; 222/600; 266/236

[58] Field of Search ..... 266/287, 275, 271, 236; 222/600, 597, 603, 606

[56] References Cited

U.S. PATENT DOCUMENTS 3,856,189 12/1974 Meier ..... 222/600
4,116,372 9/1978 Horiguchi et al. ..... 222/600
4,508,241 4/1985 Bauer et al. ..... 222/600

FOREIGN PATENT DOCUMENTS 2161368 6/1973 Fed. Rep. of Germany .
2459568 1/1976 Fed. Rep. of Germany .
2169530 7/1986 United Kingdom ..... 222/600

*Primary Examiner*—L. Dewayne Rutledge
*Assistant Examiner*—S. Kastler
*Attorney, Agent, or Firm*—Wenderoth, Lind & Ponack

[57] ABSTRACT

A pivot assembly for pivoting a cover member to a housing of a sliding closure unit includes a pivot shaft supported by the housing and connected to the cover member with play therebetween, such that upon pressing the cover member toward refractory plates of the sliding closure unit, respective sliding surfaces of the refractory plates are free of binding and are maintained substantially in uniform surface-to-surface contact. An auxiliary pivot is formed on the cover member to define a pivot axis parallel to the axis of the pivot shaft. Control members connect the pivot shaft to the auxiliary pivot to maintain a constant spacing between the pivot axis and the axis of the pivot shaft in directions parallel to the direction of movement of a movable refractory plate of the sliding closure unit. As a result, displacement of the cover member relative to the housing due to friction between the sliding surfaces of the refractory plates is prevented.

16 Claims, 3 Drawing Figures

PIVOT ASSEMBLY FOR CONNECTING A COVER MEMBER TO A HOUSING OF A SLIDING CLOSURE UNIT

BACKGROUND OF THE INVENTION

The present invention relates to a pivot assembly for connecting a cover member to a housing of a sliding closure unit employed for controlling the discharge of molten metal from a metallurgical vessel and of the type including a housing fixed to the metallurgical vessel, at least one stationary refractory plate positioned within the housing, a movable refractory plate mounted within the housing for movement relative to the stationary refractory plate, a cover member for pressing together the refractory plates to urge respective abutting sliding surfaces thereof into sealing contact, and a pivot shaft pivotally connecting the cover member to the housing so that the sliding closure unit may be opened for replacement of the refractory plates.

In this type of sliding closure unit, there must be provided play in the pivot assembly to ensure that, in the operating position of the sliding closure unit, the movable plate will be pressed, free from tilting or binding, against the bottom stationary refractory plate, or in the case of a three-plate sliding closure unit, against the stationary bottom plate and the stationary stay plate. That is, it is necessary during operation of the sliding closure unit that the sliding surfaces of the refractory plates are free of binding and are maintained in substantially uniform surface-to-surface contact under the influence of the pressure exerted by the cover member.

West German DE-OS No. 21 61 368 discloses an arrangement whereby play is provided by the cover member having therethrough a hole or opening which fits over a pivot shaft supported by the housing, the hole or opening having a larger diameter than the diameter of the shaft. Thus, play is provided to enable the cover member, and thereby the refractory plates supported thereby, to accommodate forces such as expansion, etc., during operation to ensure that the sliding surfaces of the refractory plates are free of binding and are maintained in substantially uniform surface-to-surface contact while being pressed together by the cover member. However, this arrangement is effective only up to a certain point, since during movement of the movable refractory plate, during which time friction is generated between the abutting sliding surfaces, the loose pivot assembly enables displacement of the cover member relative to the housing. To prevent this disadvantage, the above known arrangement provides abutment surfaces extending transverse to the direction of movement of the movable refractory plate to thereby prevent displacement of the cover member relative to the housing and to guide the pressing movement of the cover member toward the refractory plates.

West German DE-OS No. 24 59 568 discloses another arrangement wherein the pivot shaft of the assembly is mounted on the cover member and guided in slots provided in the housing and extending in the direction in which the refractory plates are pressed, or perpendicularly to the respective sliding surfaces thereof. These slots thereby provide free play to the cover member to uniformly urge the refractory plates against one another. A disadvantage of this known arrangement however is the relatively elaborate fabrication of the slots compared to a single hole or opening. Furthermore, in an arrangement whereby the pivot assembly extends transverse to the direction of movement of the movable refractory plate, the pivot shaft can be pressed onto the guiding surfaces of the slots due to the frictional forces generated during movement of the movable refractory plate, thereby eliminating the play of the cover member.

SUMMARY OF THE INVENTION

With the above discussion in mind, it is an object of the present invention to provide an improved pivot assembly between a housing and a cover member of a sliding closure unit, whereby it is possible to overcome the above and other prior art disadvantages.

It is a further object of the present invention to provide such a pivot assembly whereby it is possible to ensure that the sliding surfaces of the refractory plates are free of binding and are maintained in substantially uniform surface-to-surface contact under the influence of pressing by the cover member, while at the same time preventing displacement of the cover member relative to the housing due to friction generated between the sliding surfaces of the refractory plates upon movement of the movable refractory plate.

It is a specific object of the present invention to provide such a pivot assembly employable especially in sliding closure units of the type wherein the pivot shaft between the housing and the cover member extends transverse to the direction of movement of the movable refractory plate.

It is an even further object of the present invention to provide an improved sliding closure unit incorporating such pivot assembly.

These objects are achieved in accordance with the present invention by the provision of means connecting the cover member to the pivot shaft with play therebetween, thereby ensuring that the sliding surfaces of the refractory plates are free of binding and are maintained in substantially uniform surface-to-surface contact under the influence of pressure exerted by the cover member, means forming an auxiliary pivot on the cover member and defining a pivot axis parallel to the axis of the pivot shaft, and control means connecting the pivot shaft and the auxiliary pivot for maintaining a constant spacing between the pivot axis and the axis of the pivot shaft. Thus, the pivot shaft and the auxiliary pivot are mounted and positioned in a manner to be free of relative play, thereby preventing displacement of the cover member relative to the housing due to friction between the sliding surfaces of the refractory plates upon movement of the movable refractory plate.

The pivot shaft is supported by at least one boss, preferably two bosses, formed on the housing, and the connecting means comprises a hinge portion of the cover member having therethrough an opening, the pivot shaft extending through the opening with clearance between the pivot shaft and the hinge portion, preferably the hinge portion being positioned between the two bosses. The control means comprises at least one plate, preferably two plates, each having a first end connected to the pivot shaft and a second end pivoted to the auxiliary pivot. The two plates are connected to opposite ends of the pivot shaft. The auxiliary pivot comprises a pair of pivot pins fixed to the cover member and having pivoted thereto the second ends of respective of the plates. Preferably, one of the plates is fixed to the respective end of the pivot shaft, thereby forming a mounting unit, and the other plate is removably connected to the other end of the pivot shaft. In the operating position of the sliding closure unit, the auxiliary pivot and the longitudinal dimensions of the two plates extend in a single plane parallel to the sliding surfaces of the refractory plates.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

Figure 1:
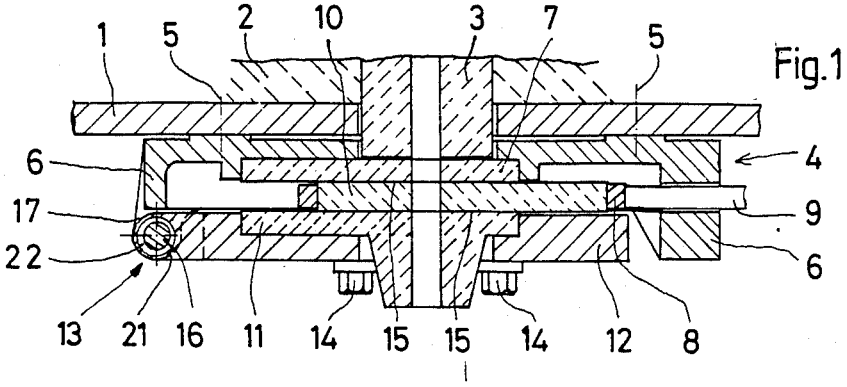
FIG. 1 is a longitudinal section through a rectilinearly movable sliding closure unit of the three-plate type and equipped with a pivot assembly according to the present invention.
Figure 2:
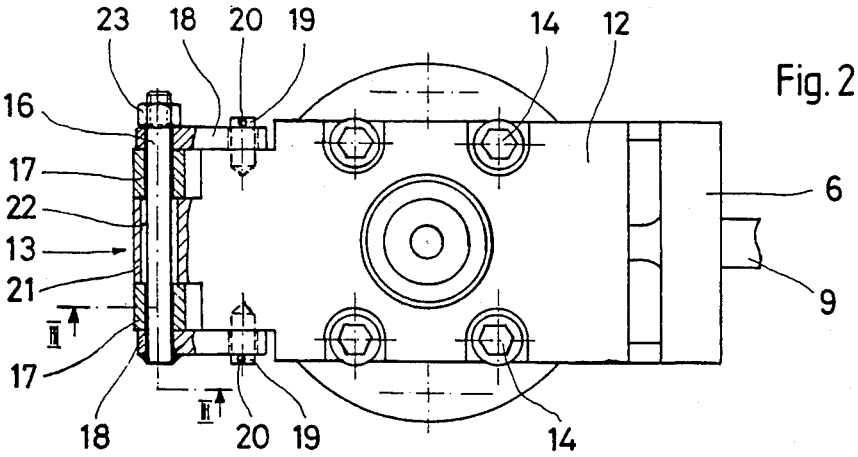
FIG. 2 is a bottom view of the arrangement of FIG. 1, the pivot assembly being shown partially in section.

In FIG. 1 is partially shown the bottom of a metallurgical vessel, for example a steel ladle, including a refractory lining 2 and a metal outer casing 1 having therethrough a nozzle brick 3 through which is to be discharged molten metal. For this purpose, mounted on metal jacket 1 is a sliding closure unit 4 of the three-plate rectilinearly movable type. Thus, the sliding closure unit includes a housing 6 fixed to the jacket 1, for example by bolts 5, an upper or bottom stationary refractory plate 7 positioned within housing 6, a lower stationary refractory plate 11 mounted within a housing cover member 12, and a movable refractory plate 10 surrounded by a frame 8 and movable by a control member 9 in opposite rectilinear directions to thereby control the discharge of molten metal from the metallurgical vessel. The cover member 12 is pivotally connected to housing 6 by means of a pivot shaft 16, and cover member 12 presses the refractory plates upwardly, for example by means of bolts 14, such that the refractory plates 7, 10, 11 are pressed together to urge respective abutting sliding surfaces 15 thereof into sealing contact. The structure described above is intended to be substantially conventional and therefore is not described in more detail.

It is essential that, during upward pressure by the cover member 12 due to bolts 14, the cover member 12 and the sliding surfaces 15 of refractory plate 7, 10, 11 be relatively adjustably movable in directions perpendicular to the directions of pressure exerted by bolts 14, and this must be achieved without hindrance by the pivot assembly 13 between the housing 6 and the cover member 12. At the same time however, due to the upward pressure tending to urge the refractory plates together, upon movement of movable refractory plate 10 there tends to be frictional forces generated between the sliding surfaces 15, and this friction tends to cause cover member 12 to be moved in the direction of movement of the movable refractory plate 10. This relative displacement of cover member 12 must however be prevented.

In accordance with the present invention, the above is accomplished by an arrangement such that pivot shaft 16 is supported by spaced apart bosses 17 formed on housing 6. A hinge portion 21 of the cover member 12 is positioned between bosses 17. Hinge portion 21 has therethrough an opening through which extends the pivot shaft 16. The opening is of a size to provide a clearance 22 between pivot shaft 16 and hinge portion 21. Accordingly, the pivot assembly 13 is constructed such that play exists between the cover member 12 and the housing 6 in directions to ensure that the sliding surfaces 15 are free of binding and are maintained in substantially surface-to-surface contact under the influence of pressing by bolts 14 and during movement of movable refractory plate 10.

Figure 3:
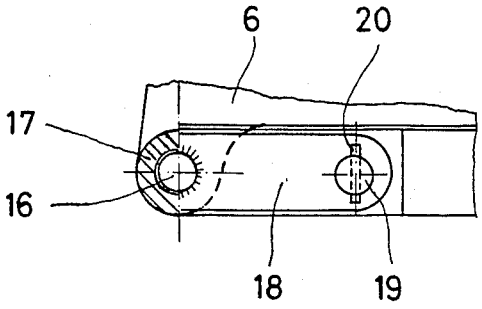
FIG. 3 is a cross sectional view taken along line III—III of FIG. 2.

Additionally, auxiliary pivot pins 19 are attached to cover member 12 in coaxial alignment and define a pivot axis which is parallel to the axis of pivot shaft 16. Control members in the form of rods or plates 18 are connected to pivot shaft 16 and are pivoted to respective pins 19 to thereby maintain a constant spacing between the pivot axis of pins 19 and the axis of pivot shaft 16. In other words, control members 18 maintain a fixed spacing between pivot shaft 16 and pivot pins 19 in the direction of movement of movable refractory plate 10. In the specifically illustrated arrangement, one plate 18 is fixed to one end of pivot shaft 16 and the other plate 18 is removably connected to the opposite end of pivot shaft 16, for example by means of a nut 23. Opposite ends of plates 18 are pivoted to respective pins 19 and retained thereon, for example by means of cotter pins 20, or the like. As shown particularly in FIG. 3, the pivot axis of pivot pins 19 and the longitudinal axes or dimensions of rods or plates 18 extend in a single plane parallel to the sliding surfaces 15 of the refractory plates.

By the above structure of the present invention there is formed essentially a double pivot assembly which enables cover member 12 to move without hindrance in directions perpendicular to the sliding surfaces 15, while maintaining cover member 12 fixedly positioned relative to housing 6 in the directions of movement of movable refractory plate 10, i.e. in directions parallel to sliding surfaces 15.

The above arrangement of the present invention particularly is useful in the illustrated arrangement wherein the axis of pivot shaft 16 extends transverse to the direction of movement of movable refractory plate 10. This arrangement provides maximum advantage of the structural features of the present invention. However, the present invention equally is applicable to arrangements wherein the pivot shaft 16 extends other than perpendicular to the direction of movement of the movable refractory plate.

Although the present invention has been described and illustrated with respect to a preferred embodiment thereof, it is to be understood that various changes and modifications may be made to the specifically described and illustrated features without departing from the scope of the present invention. It particularly is to be understood that the present invention is applicable to two-plate rectilinear sliding closure units as well as to rotary and swivelly movable sliding closure units.

I claim:

1. In a sliding closure unit for controlling the discharge of molten metal from a metallurgical vessel and of the type including a housing to be fixed to the metallurgical vessel, at least one stationary refractory plate positioned within said housing, a movable refractory plate mounted within said housing for movement relative to said stationary refractory plate, a cover member for pressing together said refractory plates to urge respective abutting sliding surfaces thereof into sealing contact, and a pivot shaft pivotally connecting said cover member to said housing, the improvement of means for ensuring that said sliding surfaces are free of binding and are maintained in substantially uniform surface-to-surface contact under the influence of said pressing by said cover member and for preventing displacement of said cover member relative to said housing due to friction between said sliding surfaces upon movement of said movable refractory plate, said means comprising:

said housing having at least one boss, said pivot shaft extending through said boss and thus being supported thereby;

means connecting said cover member to said pivot shaft with play therebetween, said connecting means comprising a hinge portion of said cover member having therethrough an opening, said pivot shaft extending through said opening with clearance between said pivot shaft and said hinge portion, said clearance between said pivot shaft and said hinge portion being greater than clearance between said pivot shaft and said boss;

auxiliary pivot means on said cover member defining a pivot axis parallel to the axis of said pivot shaft; and control means connecting said pivot shaft and said auxiliary pivot means for maintaining a constant spacing between said pivot axis and said axis of said pivot shaft.

2. The improvement claimed in claim 1, comprising two said bosses, said hinge portion being positioned between said bosses.

3. The improvement claimed in claim 1, wherein said control means comprises at least one plate having a first end connected to said pivot shaft and a second end pivoted to said auxiliary pivot means.

4. The improvement claimed in claim 3, comprising two said plates connected to opposite ends of said pivot shaft.

5. The improvement claimed in claim 4, wherein said auxiliary pivot means comprises a pair of pivot pins having pivoted thereto second ends of respective said plates.

6. The improvement claimed in claim 4, wherein one said plate is fixed to the respective said end of said pivot shaft, and the other said plate is removably connected to the respective said end of said pivot shaft.

7. The improvement claimed in claim 5, wherein in the operating position of said sliding closure unit, said auxiliary pivot means and said at least one plate extend in a plane parallel to said sliding surfaces.

8. The improvement claimed in claim 1, wherein said pivot axis extends transverse to the direction of movement of said movable refractory plate.

9. A pivot assembly, for use in a sliding closure unit for controlling the discharge of molten metal from a metallurgical vessel and of the type including a housing fixed to the metallurgical vessel, at least one stationary refractory plate positioned within the housing, a movable refractory plate mounted within the housing for movement relative to the stationary refractory plate, and a cover member for pressing together the refractory plates to urge respective abutting sliding surfaces thereof into contact, for pivotally connecting the cover member to the housing, said pivot assembly comprising:

at least one boss on the housing;

a pivot shaft extending through said boss and thus being supported thereby;

means connecting the cover member to said pivot shaft with play therebetween, and thereby for ensuring that the sliding surfaces of the refractory plates are free of binding and are maintained in substantially uniform surface-to-surface contact under the influence of pressing by the cover member, said connecting means comprising a hinge portion of the cover member having therethrough an opening, said pivot shaft extending through said opening with clearance between said pivot shaft and said hinge portion, said clearance between said pivot shaft and said hinge portion being greater than clearance between said pivot shaft and said boss;

means forming auxiliary pivot means on the cover member defining a pivot axis parallel to the axis of said pivot shaft; and control means connecting said pivot shaft and said auxiliary pivot means for maintaining a constant spacing between said pivot axis and said axis of said pivot shaft, and thereby for preventing displacement of the cover member relative to the housing due to friction between the sliding surfaces of the refractory plates upon movement of the movable refractory plate.

10. An assembly as claimed in claim 10, comprising two said bosses, said hinge portion being positioned between said bosses.

11. An assembly as claimed in claim 10, wherein said control means comprises at least one plate having a first end connected to said pivot shaft and a second end pivoted to said auxiliary pivot means.

12. An assembly as claimed in claim 11, comprising two said plates connected to opposite ends of said pivot shaft.

13. An assembly as claimed in claim 12, wherein said auxiliary pivot means comprises a pair of pivot pins having pivoted thereto second ends of respective said plates.

14. An assembly as claimed in claim 12, wherein one said plate is fixed to the respective said end of said pivot shaft, and the other said plate is removably connected to the respective said end of said pivot shaft.

15. An assembly as claimed in claim 11, wherein in the operating position of the sliding closure unit, said auxiliary pivot means and said at least one plate extend in a plane parallel to the sliding surfaces of the refractory plates.

16. An assembly as claimed in claim 9, wherein said pivot axis extends transverse to the direction of movement of the movable refractory plate.

* * * * *